US005092115A

United States Patent [19]

Stahlecker et al.

[11] Patent Number: 5,092,115

[45] Date of Patent: Mar. 3, 1992

[54] SPINNING OR TWISTING SPINDLE

[75] Inventors: Gerd Stahlecker, Eislingen/Fils; Hans Braxmeier, Süssen, both of Fed. Rep. of Germany

[73] Assignee: Fritz & Hans Stahlecker, Fed. Rep. of Germany

[21] Appl. No.: 626,438

[22] Filed: Dec. 12, 1990

[30] Foreign Application Priority Data

Dec. 21, 1989 [DE] Fed. Rep. of Germany ..... 3942403

[51] Int. Cl.[5] ..... D01H 7/08; D01H 7/14; F16C 17/04

[52] U.S. Cl. ..... 57/132; 57/135; 384/239

[58] Field of Search ..... 57/130, 132-135; 384/237, 239, 240, 229, 626, 498; 248/636, 638

[56] References Cited

U.S. PATENT DOCUMENTS

| | | | |
|---|---|---|---|
| 498,952 | 6/1893 | Chandler | 57/132 |
| 574,900 | 1/1897 | Gartner | 57/135 |
| 887,162 | 5/1908 | Westcott | 57/132 |
| 1,442,412 | 1/1923 | Münz | 57/135 |
| 2,431,134 | 11/1947 | Monnia | 57/130 |
| 2,492,091 | 12/1949 | Berg | 57/133 |
| 2,565,389 | 8/1951 | Meadows | 57/133 |
| 2,859,584 | 11/1958 | Hamilton | 57/133 |
| 3,435,604 | 4/1969 | Shotbolt | 57/134 |
| 3,552,113 | 1/1971 | Stanfert | 57/130 |
| 4,806,025 | 2/1989 | Kamiyama et al. | 384/204 X |

FOREIGN PATENT DOCUMENTS

| | | | |
|---|---|---|---|
| 106150 | 4/1898 | Fed. Rep. of Germany | 57/135 |
| 217980 | 1/1910 | Fed. Rep. of Germany | 57/135 |
| 1183415 | 12/1964 | Fed. Rep. of Germany . | |
| 2749389 | 5/1979 | Fed. Rep. of Germany . | |
| 350516 | 6/1905 | France | 57/134 |

*Primary Examiner*—Daniel P. Stodola
*Assistant Examiner*—Michael R. Mansen

[57] ABSTRACT

For a spinning or twisting spindle, a holding device is provided which comprises a pin made of a spinning-elastic material which is an extension of the spindle bearing housing, the cross-section of the pin being smaller than the cross-section of the spindle bearing housing and the pin forming a point of discontinuity.

20 Claims, 3 Drawing Sheets

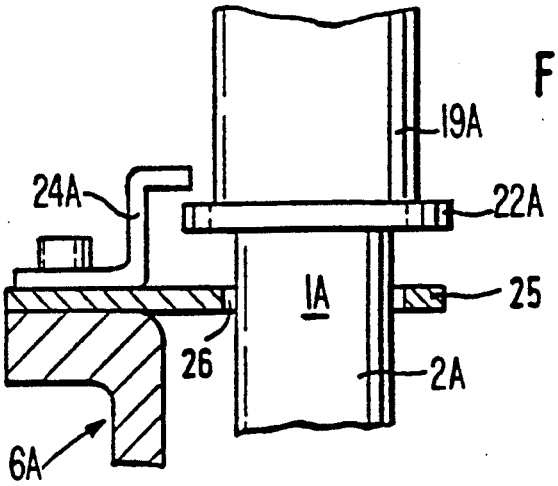
FIG. 2
FIG. 3
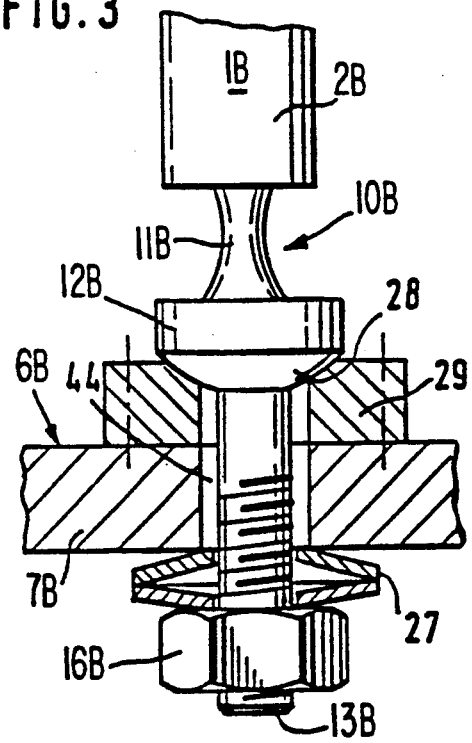
FIG. 4
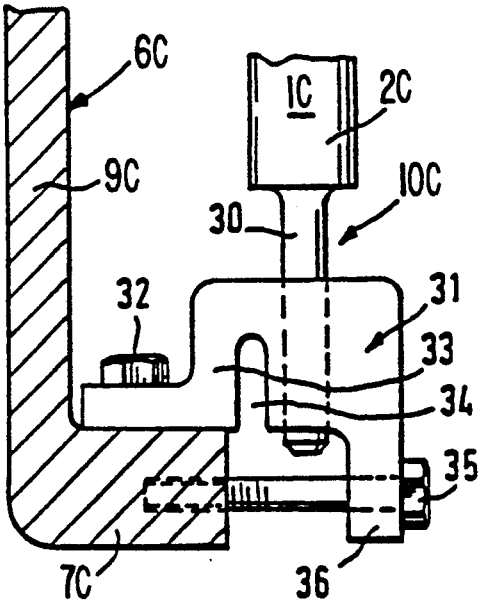

SPINNING OR TWISTING SPINDLE

BACKGROUND AND SUMMARY OF THE INVENTION

The invention relates to a spinning or twisting spindle having a vertical spindle shaft which is disposed in a spindle bearing housing by means of a bolster and a step bearing. The spindle bearing housing can be fastened to a spindle rail below the step bearing, by means of a holding device which is essentially radially spring-elastically flexible.

In the case of a spindle of the initially mentioned type (German Patent Document DE-AS 11 83 415, FIG. 6), the spindle bearing housing is arranged in an outer housing which surrounds it. The outer housing is extended beyond the area of the step bearing and is provided with transverse slots which are disposed in several planes and form a row of springy ring segments which are connected with one another by means of short webs. As a result, a type of swivel point is to be created around which the housing receiving the spindle bearing housing can be swivelled. In addition, the spindle bearing housing is held in the outer housing in an elastic manner such that it can carry out swivelling or tumbling motions inside the housing.

It is an object of the invention to provide a spinning or twisting spindle of the initially mentioned type by means of which it becomes possible to reduce the running noises.

This object is achieved according to preferred embodiments of the invention in that the holding device contains a pin made of springy materials as an extension of the spindle bearing housing, the cross-section of this pin being smaller than the cross-section of the spindle bearing housing and the pin forming a point of discontinuity.

In this case, the invention is based on the recognition that an essential cause of the running noises rests with the construction of the bolster which normally contains roller bodies. Even if this bolster is manufactured with high precision with respect to its shape and only a small play is permitted, smaller deviations still cannot be avoided. These deviations have the result that the roller bodies and thus also the spindle bearing housing are set to perform vibrations which have the effect of a sound wave. These vibrations are then transmitted by means of a so-called flow of structure-borne sound, to other machine elements which have larger surfaces capable of vibrating and thus result in an increase in the generating of noise. According to the invention, the pin forms a point of discontinuity which must be considered as a throttling point for the flow of the structure-borne sound. Vibrations of the spindle bearing housing are therefore only to a clearly reduced extent transmitted to other machine elements and particularly to the spindle rail. As a result the generating of noise is essentially reduced to the spindle bearing housing.

In a further development of the invention, it is provided that the holding device comprises devices for adjusting the angular position of the spindle. Spindles of this type are normally driven by means of a tangential belt or another belt drive which exercises a load on the spindle in the radial direction. This will result in a deformation in the area of the pin which can be compensated by the devices for the adjusting in such a manner that the spindle loaded by means of the driving belt is largely aligned perpendicularly and, in the case of a ring spindle, particularly in the center with respect to the center of the ring.

In a further development of the invention, it is provided that the pin is manufactured in one piece with the spindle bearing housing. The mounting of the pin will then not result in significantly increased manufacturing expenses because the manufacturing may take place as a machining by means of turning. In an expedient further development, it is provided that a fastening flange and a thread bolt connect to the pin serving as the point of discontinuity. These elements may also be manufactured in a simple manner in one operation in one piece with the spindle bearing housing and the pin.

In a further development of the invention, it is provided that the spindle bearing housing is surrounded by a ring made of a rubber elastic material in the area of the bolster. This ring, which may be mounted either to the spindle bearing housing or to a recess of a spindle rail, is essentially used as a safety device for preventing excessive deviations or deflections of the spindle. Stronger deflections of this type may occur, for example, during the starting of a machine and in the case of the loads occurring during the starting.

In a further development of the invention, it is provided that the spindle bearing housing is surrounded by a shell of sound-absorbing material. As a result, it is also possible to provide a further protection from the sound waves radiating from the spindle bearing housing so that a further noise reduction is obtained. It is advantageous in this case for the shell to be held at the spindle bearing housing in the area of the bolster and to surround the remaining area of the spindle bearing housing at a distance. A shell of this type may be mounted at any time later.

Other objects, advantages and novel features of the present invention will become apparent from the following detailed description of the invention when considered in conjunction with the accompanying drawings.

BRIEF DESCRIPTION OF THE DRAWINGS

FIG. 2 is a partial axial sectional view of a slightly modified embodiment in the area of the bolster;

FIG. 3 is a partial axial sectional view of a holding device of a spindle according to the invention with devices for adjusting the spindle axis;

FIG. 4 is a partial sectional view of a holding device which comprises a holder that is fastened to the spindle rail and can be adjusted in itself.

DETAILED DESCRIPTION OF THE DRAWINGS

Figure 1:
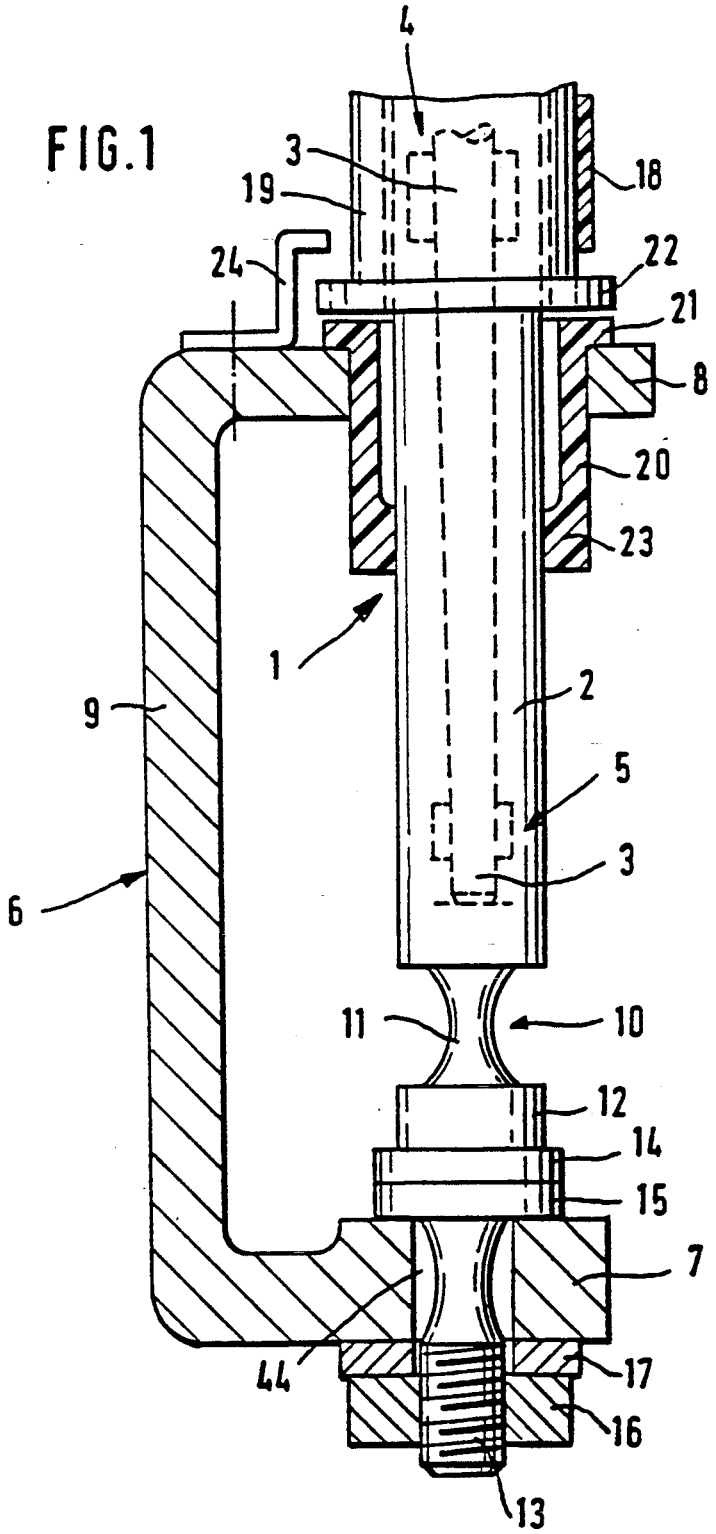
FIG. 1 is an axial sectional view of a spinning and twisting spindle constructed according to a preferred embodiment of the invention.

The spinning or twisting spindle 1 which is only partially shown in FIG. 1 has a bearing housing 2 in which a spindle shaft 3 of a spindle top part is disposed by means of a bolster 4 and a step bearing 5.

The spindle top part comprises a driving wharve 19 which reaches over the spindle bearing housing 2 and ends with a ring collar 22. A belt, particularly a tangential belt 18, is applied to this wharve 19.

The spindle 1 is arranged in a spindle rail 6 which consists of an open U-shaped profile, the web 9 of which faces the frontal side of the machine and the legs 7 and 8 of which face the inside of the machine.

As an axial extension of the spindle bearing housing 2 a pin 11 is shaped onto it below the step bearing 5 and has a significantly smaller cross-section than the spindle bearing housing 2. The pin 11 has a ring-groove-type contraction which is used as a point 10 of discontinuity. This point 10 of discontinuity has the effect that the transmission of the flow of structure-borne sound between the spindle bearing housing 2 and the elements that follow and particularly the spindle rail 6 are largely reduced. The pin 11 is followed by a fastening flange 12 with an enlarged diameter, which is followed by a threaded bolt 13. The threaded bolt 13 is fitted through a bore 44 of the lower leg 7 of the spindle rail 6 with a relatively large play.

Between the upper side of the leg 7 and the fastening flange 12, two rings 14, 15 are arranged which each have a lower wobble in the areas facing one another, that is, extend slightly diagonally with respect to the spindle shaft. A retaining nut 16 is screwed onto the threaded bolt 13, a sturdy supporting disk 17 being arranged between the leg 7 and the fastening nut 16. By means of a mutual rotating of the rings 14, 15, the angular position of the spindle shaft can be adjusted before the retaining nut 16 is completely tightened. As a result the deformations caused by the pressure forces of the belt 18 in the area of the pin 11 can be compensated so that the spindle axis may be adjusted precisely, particularly in the case of a ring spindle, precisely in the center with respect to a ring of a ring rail which is not shown.

An S-shaped securing element 24 is mounted on the upper leg 8 of the ring rail 6 and, at a distance, reaches over the ring collar 22 of the wharve 19 and thus prevents an undesirable travelling-out of the top part of the spindle. This securing element 24 which is fastened by means of screws to the spindle rail 6 may, for example, be constructed as a rail which extends along several adjacent spindles.

The upper leg 8 of the spindle rail 6 is provided with a bore which is significantly larger than the diameter of the spindle bearing housing 2. A molding 20 made of a rubber-elastic plastic material is inserted into this bore and, by means of a flange 21, rests from above against the leg 8. This molding 20 extends along a part of the length of the spindle bearing housing 2 and, in the area of its bottom 23, rests against the spindle bearing housing 2 at a distance from the leg 8. The molding 20 essentially has the purpose of damping and limiting larger deflecting motions of the spindle bearing housing 2 by means of swivelling in the area of the pin 11. For this purpose, it is expedient in certain preferred embodiments to provide the molding 20 with axial slots. Spindle deflections of this type may occur particularly during the starting of the machine or of a single spindle 1. By means of the molding 20 in connection with the bore of the flange 8 of the spindle rail 6, these deflections, on the one hand, are limited while, on the other hand, a hard impact against the spindle rail 6 is avoided.

In FIG. 2, corresponding reference numbers, with a suffix "A" are used to designate similar features as in the embodiment of FIG. 1. In the embodiment according to FIG. 2, the spindle bearing housing 2A corresponding to the embodiment of FIG. 1 is fastened to a lower flange of a spindle rail 6A. In the area below the driving wharve 19, a sheet metal plate 25 is arranged which has a bore 26 surrounding the spindle bearing housing 2A with play. In this embodiment, the sheet metal plate 25 is used as a limitation against impermissibly large deflections of the spindle bearing housing 2A which may result in a permanent deformation in the area of the pin 11A.

In FIG. 3, corresponding reference numbers, with a suffix "B" are used to designate similar features as in the embodiment of FIG. 1. Also in the embodiment according to FIG. 3, a pin 11B is provided as an extension of the spindle bearing housing 2B of a ring spindle 1B or twisting spindle and forms a point 10B of discontinuity. In the area of this spring-elastic pin 11B, an imaginary point develops as in the case of the embodiment according to FIG. 1 around which the spindle bearing housing 2B can carry out bending deflections so that it is radially elastically flexible in its upper part. A widened fastening flange 12B, which is followed by a threaded bolt 13B, is molded to the pin 11B molded to the spindle bearing housing 2B. A calotte-type supporting surface 28 connects to the fastening flange 12B and is guided in a disk 29 which has a corresponding ball-socket-type recess. The disk 29 is fastened to the lower leg 7B of the spindle rail 6B by means of screws. The threaded bolt 13 penetrates the disk 29 and the lower leg 7B in bores 44 with a relatively large play. An elastic intermediate element in the form of a cup spring assembly 27 is arranged between a nut 16B screwed onto the thread bolt 17 and the lower leg 7B of the spindle rail 6B. As long as the nut 16 is not completely tightened, the spindle bearing housing 2B can be adjusted in its axial direction, particularly for the compensation of a bending deformation in the area of the pin 11B which is caused by the loading by means of the driving belt.

In FIG. 4, corresponding reference numbers, with a suffix "C" are used to designate similar features as in the embodiment of FIG. 1. In the embodiment according to FIG. 4, the spindle bearing housing 2C of a ring spindle or twisting spindle 1C is also provided with a pin 30 as an axial extension, this pin forming a point 10 of discontinuity. The pin 30 is inserted in a holder 31 into which it is pressed and screwed. By means of one or two screws 32, the holder 31 is fastened to the lower leg 7C of a spindle rail 6C. Between the fastening part 33 and a part 34 of the holder 31 receiving the pin 30, a thin point is provided in the area of which the holder 31 can be elastically bendingly deformed around an imaginary axis extending essentially transversely with respect to the spindle axis. A projection 36 is molded onto the part 34 and, by means of one or two screws 35, is fastened with the lower leg 7C of the spindle rail 6C. By means of the adjusting of the screws 35, an elastic deformation in the holder 31 can be caused in the area between the thin point between the fastening part 33 and the holding part 34, the slope of the spindle shaft being adjustable by means of the elastic deformation. As a result, elastic binding deformations in the area of the pin 30 can be compensated so that the spindle shaft is aligned precisely perpendicularly and/or in the center with respect to a ring of a ring rail 6C.

Figure 5:
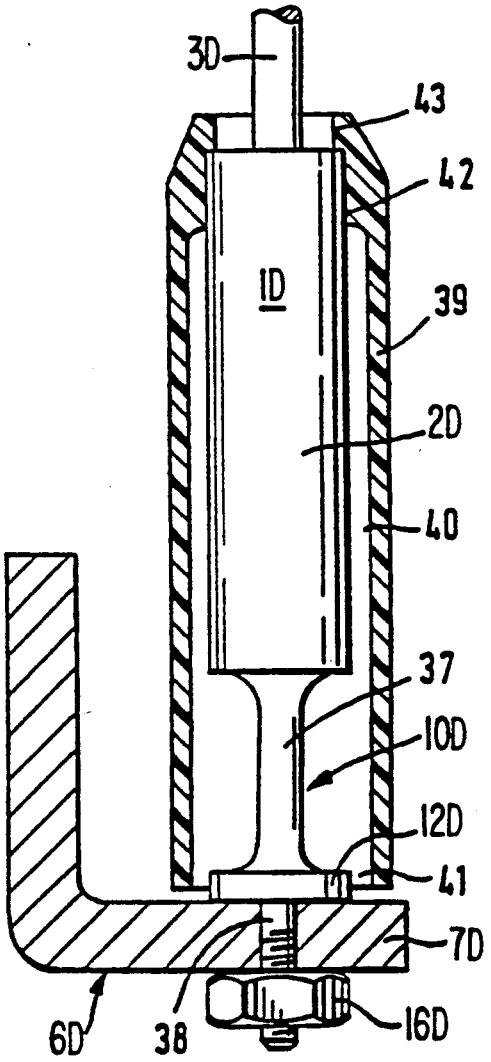
FIG. 5 is an axial sectional view of an embodiment in which the spindle bearing housing is surrounded by a shell made of a sound-absorbing material.

In FIG. 5, corresponding reference numbers, with a suffix "D" are used to designate similar features as in the embodiment of FIG. 1. In the embodiment according to FIG. 5, the spindle bearing housing 2D of a ring spindle or twisting spindle 1D is also provided with a pin 37 arranged as an axial extension which forms a point 10D of discontinuity. The pin 37 merges into a fastening flange 12D and a connecting threaded bolt 38 by means of which the spindle bearing housing 2D is fastened by way of a nut 16D to the lower leg 7D of a spindle rail 6D which in this embodiment is constructed as an angle section.

In the embodiment according to FIG. 5, it is also provided that the spindle bearing housing 2D is surrounded with a shell 39 which preferably is manufactured from a porous plastic material. By means of a ring guide 42 and a collar 43, the shell 39 is connected in the area of the upper end with the spindle bearing housing 2D. The shell 39 surrounds the remaining area of the spindle bearing housing 2D at a distance while leaving a gap 40. In the axial direction, the shell 39 not only extends over the spindle bearing housing 2D but also over the area of the pin 37 to the area of the fastening flange 12D which it surrounds with play 41. This shell 39, which may also be mounted on existing spindles as a subsequently delivered part, has the purpose of reducing the noise level by shielding the spindle bearing housing 2D.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A spinning or twisting spindle arrangement comprising:

a spindle bearing housing, a bolster and a step bearing in the spindle bearing housing for rotatably supporting a spindle shaft, and holding means for holding the spindle bearing housing at a spindle rail, wherein the holding means includes a pin constructed as a fixed extension of the spindle bearing housing, said pin exhibiting a radial cross-sectional area which is smaller than the radial cross-sectional area of the spindle bearing housing to thereby form a point of discontinuity between the spindle bearing housing and the spindle rail for limiting transmission of structure borne sound from the bearing to the spindle rail.

2. An arrangement according to claim 1, wherein the holding means comprises adjusting means for adjusting the angular position of a spindle shaft.

3. An arrangement according to claim 2, wherein the pin is manufactured in one piece with the spindle bearing housing.

4. An arrangement according to claim 3, wherein a fastening flange and a threaded bolt connect to the pin serving as the point of discontinuity.

5. An arrangement according to claim 4, wherein the fastening flange is designed in the manner of a calotte on its side facing the thread bolt to which calotte a ball-socket-type supporting disk is assigned.

6. An arrangement according to claim 5, wherein the holding means comprises a spring element generating an axial clamping force, particularly a cup spring assembly.

7. An arrangement according to claim 6, wherein the spindle bearing housing is surrounded in the area of the bolster by a ring type sleeve molding made of a rubber-elastic material.

8. An arrangement according to claim 2, wherein the spindle bearing housing is surrounded in the area of the bolster by a ring type sleeve molding made of a rubber-elastic material.

9. An arrangement according to claim 1, wherein the pin is held in a holder which can be fastened to a spindle rail and which is equipped with adjusting means for adjusting the angular position of the spindle.

10. An arrangement according to claim 9, wherein the holder includes an elastically deformable area between a part that can be fastened to a spindle rail and a part that carries the spindle bearing housing.

11. An arrangement according to claim 1, wherein the pin is manufactured in one piece with the spindle bearing housing.

12. An arrangement according to claim 1, wherein a fastening flange and a threaded bolt connect to the pin serving as the point of discontinuity.

13. An arrangement according to claim 12, wherein the fastening flange is designed in the manner of a calotte on its side facing the thread bolt to which calotte a ball-socket-type supporting disk is assigned.

14. An arrangement according to claim 1, wherein the holding means comprises a spring element generating an axial clamping force, particularly a cup spring assembly.

15. An arrangement according to claim 1, wherein the spindle bearing housing is surrounded in the area of the bolster by a ring type sleeve molding made of a rubber-elastic material.

16. An arrangement according to claim 1, wherein the spindle bearing housing is surrounded by a shell made of a sound-absorbing material.

17. An arrangement according to claim 16, wherein the shell in the area of the bolster is held at the spindle bearing housing and surrounds the remaining area of the spindle bearing housing at a distance.

18. An arrangement according to claim 17, wherein the spindle bearing housing is surrounded in the area of the bolster by a ring type sleeve molding made of a rubber-elastic material.

19. An arrangement according to claim 1, further comprising a vertically extending spindle shaft supported in the spindle bearing housing.

20. An arrangement according to claim 1, wherein said holding means is essentially radially, elastic flexible.

* * * * *